US005421952A

United States Patent [19]

Buchholz et al.

[11] Patent Number: 5,421,952

[45] Date of Patent: Jun. 6, 1995

[54] METHOD FOR THE MANUFACTURE OF SILICON INJECTION PLATES AND SILICON PLATES PRODUCED THEREBY

[75] Inventors: Juergen Buchholz, Lauffen; Udo Jauernig, Reutlingen; Alexandra Boehringer, Ditzingen; Guenther Findler, Stuttgart; Horst Muenzel, Reutlingen, all of Germany

[73] Assignee: Robert Bosch GmbH, Germany

[21] Appl. No.: 131,512

[22] Filed: Oct. 4, 1993

[30] Foreign Application Priority Data

Oct. 7, 1992 [DE] Germany ..... 42 33 703.8

[51] Int. Cl.[6] ..... B05B 1/00

[52] U.S. Cl. ..... 216/33; 216/99; 216/47

[58] Field of Search ..... 156/644, 647, 662, 633, 156/629, 654, 659.1

[56] References Cited

U.S. PATENT DOCUMENTS

| | | | |
|---|---|---|---|
| 4,733,823 | 3/1988 | Waggener et al. | 156/644 X |
| 4,808,260 | 2/1989 | Sickafus et al. | 156/644 |
| 4,863,560 | 9/1989 | Hawkins | 156/644 |
| 5,160,577 | 11/1992 | Deshpande | 156/644 |

FOREIGN PATENT DOCUMENTS 4112150 3/1992 Germany .

*Primary Examiner*—Thi Dang
*Attorney, Agent, or Firm*—Kenyon & Kenyon

[57] ABSTRACT

A method for fabricating silicon injection plates is both highly precise and particularly simple. The silicon injection plate is formed by an upper silicon plate having injection holes and a lower silicon plate having a through opening and channels. The lower silicon plate is fabricated by simultaneous, double-sided etching of silicon.

6 Claims, 2 Drawing Sheets

METHOD FOR THE MANUFACTURE OF SILICON INJECTION PLATES AND SILICON PLATES PRODUCED THEREBY

BACKGROUND OF THE INVENTION

The present invention relates to a method for manufacturing silicon injection plates. In particular, the method of the present invention produces silicon injection plates by bonding an upper plate having an injection hole to a lower plate having a through hole arranged beneath the injection hole, at least one of the plates including recesses for forming channels between the through hole and an outer edge of the injection plates.

German Application No. 41 12 150 describes a silicon injection plate produced by bonding an upper silicon plate to a lower silicon plate. The upper silicon plate has injection holes and the lower silicon plate has at least one through-going hole. Recesses through which channels are formed connect the through hole with the outer edge of the silicon injection plate. A gas, such as air for example, is blown or drawn in through these channels to assure a better atomization of the liquid flowing through the injection holes. The silicon plates are fabricated by anisotropic etching. The lower silicon plate is fabricated by first etching a passage opening in the lower silicon plate completely from its bottom to its top. If the recesses for the channels are provided in the lower silicon plate, this fabrication step is preformed after the etching of the through opening in the lower silicon plate.

Unfortunately, a sequence of etching steps is required to fabricate the device described in German Application No. 41 12 150. Further, the etching steps must be precisely performed to assure good atomization. Thus, a simplified method of fabricating silicon plates in which good atomization always results is needed.

SUMMARY OF THE INVENTION

The method of the present invention advantageously anisotropically etches each side of the silicon simultaneously, thereby reducing the number of necessary steps for fabricating the silicon injection plates. In this way, the silicon injection plates can be produced at lower cost. In the silicon plate formed by the method of the present invention, the through hole and the recess for channels are arranged symmetrically with respect to the center line of the silicon plate, thereby advantageously permitting relatively slight manufacturing tolerances during production.

The method of the present invention is particularly simple when etching masks are placed on each of the top and bottom surfaces of the lower silicon plate and the etch solution acts on the silicon plate approximately as long as is necessary to etch through half the thickness of the silicon plate. By using {100} (i.e., Miller index of 100) silicon for the lower silicon plate, the present invention provides a particularly symmetrical construction which assures a good atomization of the fluid entering through the injection holes. X-shaped recesses for the through opening and the channels in this {100} silicon plate is preferred.

By using a compensation structure for the convex corners of the recess, the present invention assures precisely defined structures. By forming all arms of the X-shaped recesses to have the same width and by forming the compensation structures from cross pieces of an etching mask which bridge the convex corners of the recess which are opposite each other, the present invention assures particularly smooth corners, the shape of which is symmetrical with respect to the channels. With such smooth corners, the conditions of flow in the channels are particularly easy to reproduce, thereby providing a particularly good atomization of the fluid flowing through the injection holes.

DETAILED DESCRIPTION

Figure 1:
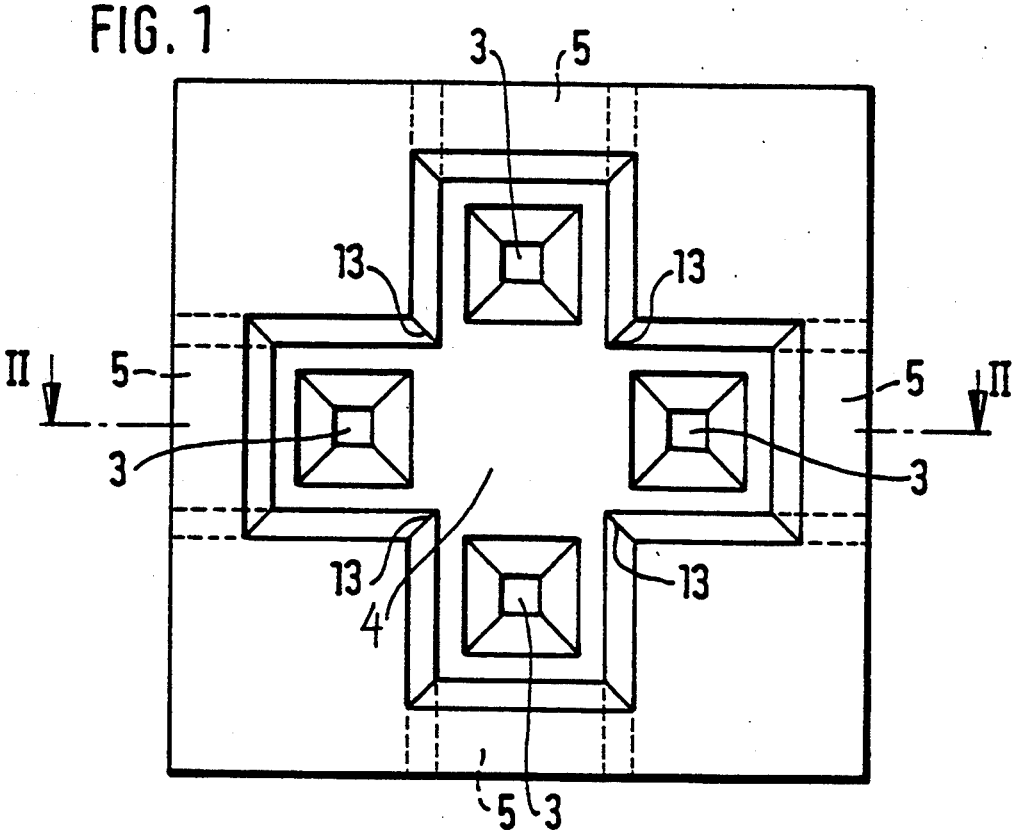
FIG. 1 is a bottom view illustrating a silicon injection plate.
Figure 2:
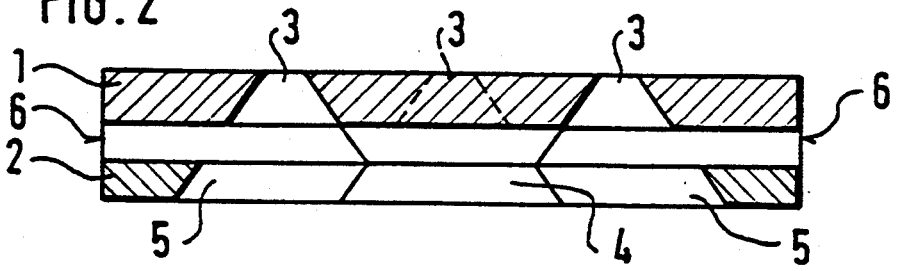
FIG. 2 is a cross section through the silicon injection plate illustrated in FIG. 1.

FIG. 1 is a bottom view and FIG. 2 is a cross sectional view illustrating a silicon injection plate. The silicon injection plate includes an upper silicon plate 1 with injection holes 3 contained therein and of a lower silicon plate 2 having at least one through-hole 4. Furthermore, the lower silicon plate 2 has recesses which are closed by the upper silicon plate such that channels 5 are produced which extend from the through hole 4 up to the outer edge 6 of the silicon injection plate. The cross section shown in FIG. 2 corresponds to a section through FIG. 1 along the line II—II.

The upper silicon plate 1 includes four openings 3 which, as shown in FIG. 2, have a trapezoidal cross section. Such openings 3 can be obtained in particularly simple manner by anisotropic silicon etching in {100} silicon plates. The side walls of the injection holes 3 are formed in the {111} crystal directions of the silicon single crystal. To produce such injection holes 3, an etching mask, which does not cover square regions of the silicon plate 1, is placed on the upper silicon plate 1. The edges of this square opening lie on {111} crystal planes which form an angle of about 54.74° with the surface of the upper silicon plate 1. The injection holes 3 are then etched into the silicon plate 1 by subjecting the plate to a basic etching solution such as a KOH solution for example.

Figure 3:
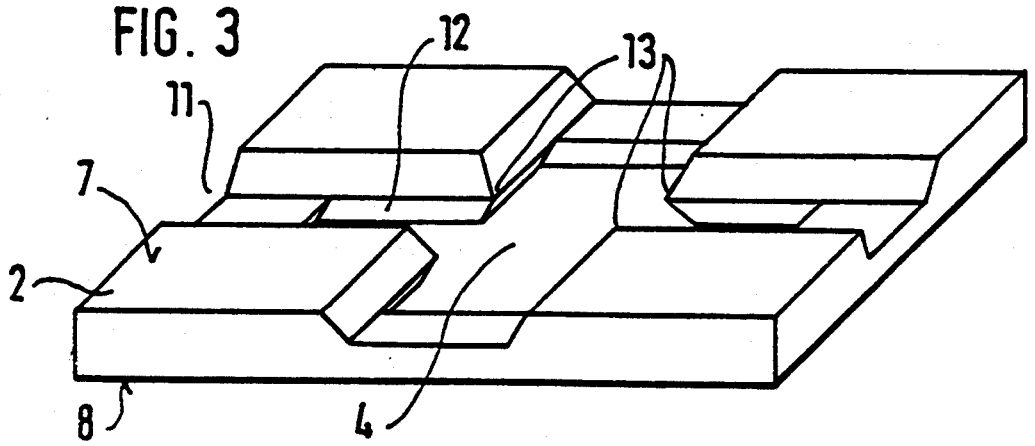
FIG. 3 is a perspective view illustrating the lower silicon plate.
Figure 4:
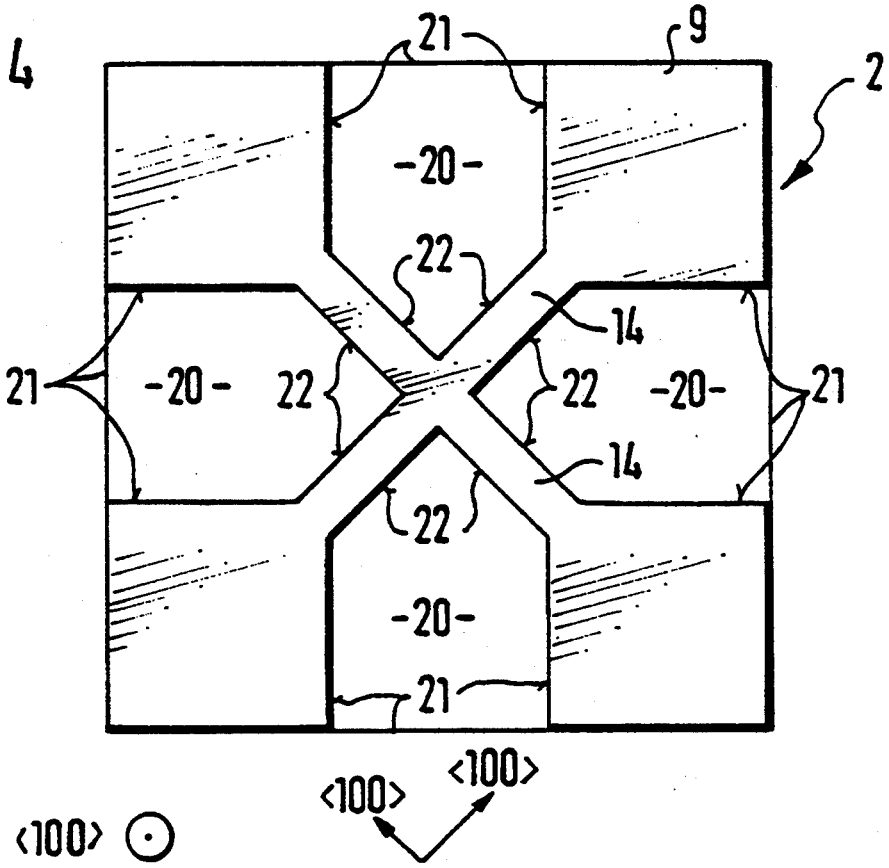
FIG. 4 is a top view illustrating the etching mask used on the top surface of the lower silicon plate.
Figure 5:
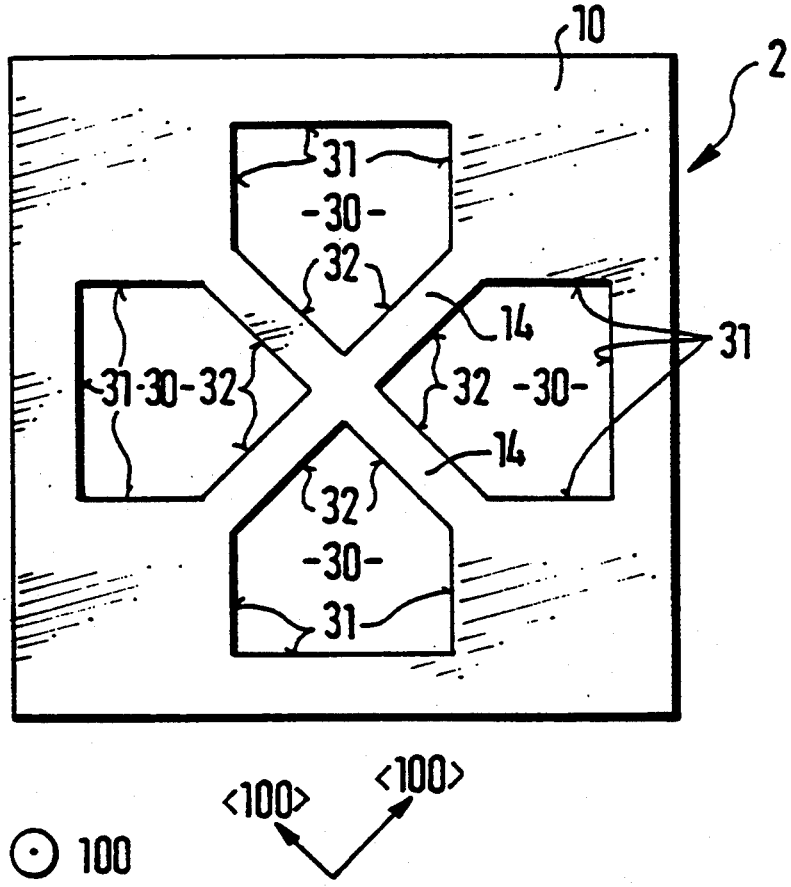
FIG. 5 is a top view illustrating the etching mask used on the bottom surface of the lower silicon plate.

The fabrication of the lower silicon plate 2 is described in detail referring to FIGS. 3 through 5.

The two silicon plates 1, 2 are attached to each other by a justified bonding process. In such a bonding process, the surfaces of the silicon plates 1, 2 are preheated and the silicon plates 1, 2 are placed, justified, one on top of the other, and are then heat treated. When pretreating the surface of the silicon plates 1, 2, thin layers of glass or silica, for example, can be produced or deposited on the surface of the silicon plates 1, 2. Other methods of surface pretreatment include dipping the silicon plates 1, 2 into etching and cleaning solutions. The connection between the two silicon plates 1, 2 improves as the surface area available increases.

With the crosswise arrangement of the four injection holes 3, a particularly large connecting surface between the two silicon plates 1 and 2 is obtained by the X-shaped (or plus-shaped) through hole 4. If, for instance, the four injection holes 3 form the corners of a square, the space required for a suitable through hole 4 would be comparatively greater if the injection holes 3 have the same position with respect to each as in the X-wise arrangement shown here. Furthermore, associating at least one separate channel 5 with each injection hole 3 permits improved atomization.

The function of the silicon injection plate shown here is described, for instance, in FIG. 1 of German Application No. 41 12 150. For example, a liquid is sprayed via the injection hole 3 through the through hole 4. The liquid is atomized by a stream of air entering through the channels 5.

The injection plates can be produced using silicon wafers. First, a plurality of structures for silicon injection plates on the wafers fabricated in are parallel. Only in a final process step are the silicon wafers sawed into individual silicon injection plates. The outer edge 6 of the silicon injection plates is defined by these saw cuts.

FIG. 3 is a perspective view illustrating the lower silicon plate 2. In the top surface 7 of the silicon plate 2, an X-shaped (or plus-shaped) recess 11 is etched, the arms of which extend to the edge of the silicon plate 2. A second X-shaped (or plus-shaped) recess 12 is etched from the bottom surface 8 of the silicon plate 2. However, the arms of the second X-shaped recess do not extend to the edge of the silicon plate 2. The depth of the recesses 11, 12 both extend to the cross sectional center of the silicon plate so that, in areas in which the two recesses 11, 12 intersect, an X-shaped through hole 4 is formed. The side walls of the recesses 11, 12 are formed by {111} planes of the silicon single crystal of the silicon plate 2. The bottom of the recess 11 is formed by a {100} crystal plane of the silicon single crystal.

The two recesses 11, 12 are formed in the silicon plate 2 by covering the top surface 7 and the bottom surface 8 of the silicon plate 2 with etching masks 9 and 10, respectively. The etching masks 9 and 10 are illustrated in FIGS. 4 and 5, respectively. A basic etch solution, for instance a solution of KOH, is applied to the silicon plate 2, covered by the etching masks 9, 10 so that the regions of the silicon plate 2 not covered by the etching mask are etched. This etching is continued until each of the two recesses 11, 12 reaches the center of the cross section of the silicon plate 2 thereby combining to form the through opening 4. In this etching process, additional measures are taken to protect the convex corners 13. The convex corners 13 have at their tip, crystal planes which are etched by anisotropically acting etch solutions to a far greater extent than the {111} crystal planes which form the side walls of the recesses 11, 12. The corresponding steps will be described referring to FIGS. 4 and 5.

FIG. 4 is a view illustrating the top surface 7 of the silicon plate 2 with the etching mask 9 applied. The etching mast 9 consists of a material which is not attacked by the basic etch solution used to etch the silicon plate 2. Such etching masks can, for instance, be formed by the application of metal layers or silica or silicon nitride.

The regions 20 of the top of the silicon plate 2 are not covered by the etching mask and are therefore etched by the etch solution. The regions 20 have a pentagonal shape, three of the sides 21 lying on {111} planes which form an angle of about 54.74° with the {100} surface of the silicon plate 2, i.e. these edges of the etching mask are oriented in {110} direction. Starting from these edges, {111} etching flanks are produced which form an angle of 54.74° with the {100} surface of the silicon plate 2. Furthermore, each of the surfaces 20 has two edges 22 which lie on {100} planes perpendicular to the {100} surface of the silicon plate 2, i.e. these edges of the etching mask point in {100} direction. Starting from these edges 22, vertical {100} etching flanks are produced.

The exposed regions 20 are so arranged that two intersecting crosswise structures 14 of the mask 9 are formed by the {100} edges 22 in the center of the silicon plate 2. These crosswise structures 14 effectively protect the convex corners 13 of the silicon plate 2. That is, if the silicon plate 2 shown here is subjected to a basic etch solution, then the {111} crystal directions of the silicon single crystal are etched only to a negligible extent. The etch solution acts predominantly in the {100} direction, i.e., a recess is etched into the top side 7 of the silicon plate 2. Since the cross-wise structures 14 are also aligned on {100} crystal directions, the cross-wise structures 14 are under-etched with the same speed as depthwise etching takes place.

If the width of the cross-wise structures 14 corresponds precisely to the thickness of the silicon plate 2, then, upon simultaneous etching of both sides of the silicon plate 2, the cross-wise structures 14 are completely under-etched when the recesses from the top side 7 and the bottom side 8 meet just in the center of the silicon plate 2. Hence, the cross-wise structures 14 permit a convex corner 13 to be formed at one moment by two converging {111} side walls of the recesses. If the etching is interrupted shortly before this, a certain balance of silicon will remain on the tip of the convex corners 13. If top etching is effected for a short time, the tips of the convex corners 13 are slightly etched.

Compensation structures for convex corners are customary in silicon etching. However, the cross-pieces 14 used in the present invention are particularly advantageous specifically for forming flow channels. The compensation structure formed for the convex corners 13 by the cross-pieces 14 is symmetrical. As a result, with slight under-etching or over-etching, all four convex corners 13 have the same shape. Hence, the flow conditions in the channels 5 are substantially unaffected, aside from slight manufacturing tolerances. A symmetrical development of all four channels 5 is of substantially greater importance for the function of the injection plate than for satisfying the absolute values of the dimensions of the channels 5 since even small asymmetries of the convex corners 13 in the case of the channels 5 shown here lead to a non-uniform atomization of the liquid entering through the injection holes 3. The compensation structure shown here for the convex corners 13 is therefore particularly advantageous for producing silicon injection plates.

FIG. 5 illustrates the bottom surface 8 of the silicon plate 2 with etching mask 10 applied to it. Pentagonal openings 30 are formed on the etching mask 10. Three edges 31 of each opening 30 are again located on a {111} plane which forms an angle of about 54.74° with the surface of the {100} oriented silicon plate 2. The edges 32 of the exposed regions 30 are again located on {100} crystal planes which are at a right angle to the {100} surface of the silicon plate 2. The edge 32 defines crosswise structures 14 which protect the convex corners 13 when etching the bottom surface 8 of the silicon plate 2. The exposed regions 30 in this case to not extend to the edge of the silicon plate 2. With the etching mask 10, an X-shaped opening is thus made in the bottom of the silicon plate 2. The arms of this X-shaped opening do not extend to the edge of the silicon plate 2.

What is claimed is:

1. A method of producing silicon injection plates, comprising the steps of:

a) fabricating a lower silicon plate by simultaneous, double-sided, anisotropic etching of a silicon wafer, the lower silicon plate having a through-hole;

b) forming channels between the through-hole and at least one outer edge of the lower silicon injection plate;

c) arranging an upper silicon plate, having an injection hole, on the lower silicon plate such that the injection hole is arranged above the through-hole; and d) bonding the upper silicon plate with the lower silicon plate.

2. The method of claim 1, wherein the step of fabricating the lower silicon plate includes the substeps of:

i) arranging a first etching mask on a bottom surface of the lower silicon plate and a second etching mask on a top surface of the lower silicon plate such that, in regions of the through-hole on the top surface and bottom surface and in regions of the channels on the top surface, the first and second etching masks define openings whereby such regions are not protected by the first and second etching masks from an etching solution; and ii) etching the lower silicon plate with the etching solution until half of the thickness of the lower silicon plate is etched from each of the top surface and bottom surface of the lower silicon plate.

3. The method of claim 2, wherein the lower silicon plate has a {100} crystal orientation and wherein said step of etching further includes the steps of:

i) etching a first X-shaped recess into the lower silicon plate starting from its top surface such that arms of the first X-shaped recess extend to the edges of the silicon plate; and ii) etching a second X-shaped recess into the bottom surface of the lower silicon plate such that arms of the second X-shaped recess extend short of the edges of the silicon plate, wherein the first and second X-shaped recesses lie one above the other and have a depth such that they form an X-shaped through-hole.

4. The method of claim 3, wherein said step of etching further includes the sub-step of protecting convex corners of the first and second X-shaped recesses which are formed by converging {111} planes of the silicon plate with a compensation structure.

5. The method of claim 4, wherein:

the arms of the first X-shaped recess on the top surface of the lower silicon plate have the same width;

the arms of the second X-shaped recess on the bottom surface of the lower silicon plate have the same width;

the compensation structure is formed by cross-pieces which extend from each of the opposite convex corners to a diagonally opposite corner; and the edges of the cross pieces lying on {100} planes of the lower silicon plate are perpendicular to the {100} surface of the lower silicon plate.

6. A method for fabricating a silicon injection plate to be used with an upper injection plate having an injection hole, the silicon injection plate having an upper surface, a lower surface, and four edges, a plus-shaped through-hole, a plus-shaped recess extending from four edges of the plus-shaped through-hole to the four edges of the silicon plate, the method comprising the steps of:

a) arranging a first etching mask on the upper surface of the silicon plate, the first etching mask including four pentagonal cut-outs defining four arms of the plus-shaped recess, and defining an X-shaped mask cross member in a center region of the first etching mask;

b) arranging a second etching mask on the lower surface of the silicon plate, the second etching mask including four pentagonal cut-outs defining four arms of the plus-shaped through-hole, and defining an X-shaped mask cross member in a center region of the second etching mask; and c) anisotropically and simultaneously etching both the upper and lower surface of the silicon plate until the plus-shaped through-hole is formed.

* * * * *